US006351932B1

(12) United States Patent
Hummel

(10) Patent No.: US 6,351,932 B1
(45) Date of Patent: Mar. 5, 2002

(54) CUT-RESISTANT ANTIMICROBIAL YARN AND ARTICLE OF WEARING APPAREL MADE THEREFROM

(75) Inventor: Joseph Hummel, Perkasie, PA (US)

(73) Assignee: Wells Lamont Industry Group, Morton Grove, IL (US)

( * ) Notice: Subject to any disclaimer, the term of this patent is extended or adjusted under 35 U.S.C. 154(b) by 0 days.

(21) Appl. No.: 09/347,330

(22) Filed: Jul. 2, 1999

(51) Int. Cl.[7] ..... D02G 3/02
(52) U.S. Cl. ..... 57/210; 57/230
(58) Field of Search ..... 57/210, 232, 230, 57/250, 258; 428/395, 375, 378; 2/2.5, 167

(56) References Cited

U.S. PATENT DOCUMENTS

| | | | | |
|---|---|---|---|---|
| 3,739,400 A | | 6/1973 | Colehower | |
| 4,128,529 A | * | 12/1978 | Becker et al. | 57/258 X |
| 4,470,251 A | * | 9/1984 | Bettcher | 57/230 |
| 4,651,514 A | | 3/1987 | Collett | |
| 4,838,017 A | * | 6/1989 | Kolmes et al. | 57/210 |
| 4,842,932 A | * | 6/1989 | Burton | 428/375 |
| 4,936,085 A | * | 6/1990 | Kolmes et al. | 57/210 X |
| 5,070,540 A | * | 12/1991 | Bettcher et al. | 2/2.5 |
| 5,135,811 A | * | 8/1992 | White et al. | 428/375 X |
| 5,177,948 A | * | 1/1993 | Kolmes et al. | 57/230 X |
| 5,442,815 A | * | 8/1995 | Cordova et al. | |
| 5,568,657 A | * | 10/1996 | Cordova et al. | |
| 5,628,172 A | * | 5/1997 | Kolmes et al. | 57/210 |
| 5,674,513 A | | 10/1997 | Snyder, Jr. et al. | |
| 5,721,179 A | * | 2/1998 | Shi et al. | 57/210 X |
| 5,822,791 A | * | 10/1998 | Baris | |
| 5,845,476 A | * | 12/1998 | Kolmes | 57/230 X |
| 5,919,554 A | * | 7/1999 | Watterson, III et al. | 428/378 X |
| 5,965,223 A | * | 10/1999 | Andrews et al. | |
| 6,016,648 A | * | 1/2000 | Bettcher et al. | 57/230 |
| 6,037,057 A | * | 3/2000 | Hartzog et al. | 428/375 X |
| 6,260,344 B1 | | 7/2001 | Chakravarti | |
| 6,266,951 B1 | | 7/2001 | Chakravarti | |

FOREIGN PATENT DOCUMENTS

| | | | | |
|---|---|---|---|---|
| JP | 53-45443 | * | 4/1978 | 57/250 |
| JP | 60-209038 | * | 10/1985 | 57/250 |
| WO | 9935315 | * | 7/1999 | 428/221 |

* cited by examiner

*Primary Examiner*—Rodney M. Lindsey
(74) *Attorney, Agent, or Firm*—Watts, Hoffmann, Fisher & Heinke Co.

(57) ABSTRACT

A yarn having cut-resistant and antimicrobial properties. The yarn includes at least one core fiber, and preferably two core fibers. Examples of core fibers include fiberglass, polyester fibers, and high density polyethylene fibers. The core fibers are overwrapped with counter helixes of a cut resistant fiber and an antimicrobial fiber. An example of a cut resistant fiber is a high density polyethylene, and an example of a fiber having a antimicrobial substance is MICRO-SAFE® acetate fiber manufactured by Celenese. The yarn is particularly suited for use in making gloves and other protective apparel worn by individuals handling and processing food. The antimicrobial substance is embedded in the yarn so that the apparel is reusable and can be subjected to numerous washings without washing away the antimicrobial.

20 Claims, 2 Drawing Sheets

CUT-RESISTANT ANTIMICROBIAL YARN AND ARTICLE OF WEARING APPAREL MADE THEREFROM

FIELD OF THE INVENTION

The present invention relates to a cut-resistant yarn for use in the manufacture of protective coverings such as gloves and other apparel items, and more particularly, the present invention relates to a cut-resistant yarn and glove having antimicrobial properties.

BACKGROUND OF THE INVENTION

Gloves and other protective apparel are typically worn by individuals handling and processing food, such as, individuals working in the meat packing industry. Preferably, the gloves should be cut-resistant to maximize the useful life of the glove and to provide a degree of protection to the wearer against injury. In addition, the glove should not overly limit the wearer's needed dexterity and tactile sensitivity.

Since the gloves and other protective apparel directly contact the food being handled, the gloves and apparel should be clean and germ-free. In order to maintain the gloves in a clean condition, the gloves are frequently laundered in commercial laundry machines. Thus, any microbial coating or other germ-killing substance applied to the gloves and other apparel will wash off during each washing and must be reapplied after each washing or the apparel must be prematurely discarded after a single use.

The disclosure of U.S. Pat. No. 4,651,514 issued to Collett provides an example of a cut-resistant yarn. The disclosed cut-resistant yarn has a core of nylon with a first wrap of an aramid fiber and a second wrap of a textured nylon.

An example of a cut-resistant glove is provided by the disclosure of U.S. Pat. No. 5,568,657 issued to Cordova et al.. "Comparative Example 10" of the Cordova patent discloses a yarn having a core of ECG 75 fiberglass filaments and 650 denier SPECTRA® overwrapped with counter opposing helixes of 650 denier SPECTRA®. SPECTRA® is the name of a high-density polyethylene fiber manufactured by Allied Signal. "Comparative Example 12" of the Cordova patent discloses a yarn having a core of ECG 75 fiberglass filaments and a 500 denier polyester fiber overwrapped with counter opposing helixes of the same 500 denier polyester fiber.

Although the above referenced cut-resistant yarns, gloves and apparel are satisfactory for their intended purposes, there is a need for a yarn which provides both cut-resistant and antimicrobial functions. The antimicrobial property should prevent the propagation of germs onto food being handled and processed. Preferably, the antimicrobial should be permanently embedded in the yarn so that, even after numerous washings, the antimicrobial is present in the apparel made from the yarn.

OBJECTS OF THE INVENTION

With the foregoing in mind, a primary object of the present invention is to provide a cut-resistant yarn with a long lasting antimicrobial.

Another object of the present invention is to provide long lasting and reuseable protective apparel made from the cut-resistant antimicrobial yarn such that the antimicrobial is substantially permanently embedded therein and is present after numerous washings.

A further object of the present invention is to provide a reuseable and washable cut-resistant antimicrobial glove particularly suited for use by those handling and processing food.

SUMMARY OF THE INVENTION

More specifically, the present invention provides a cut-resistant yarn for fabricating into reuseable and washable protective apparel particularly useful in food processing and handling. The yarn has a core including at least one strand of fiberglass which is overwrapped with a helix of a fiber having an antimicrobial embedded therein.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
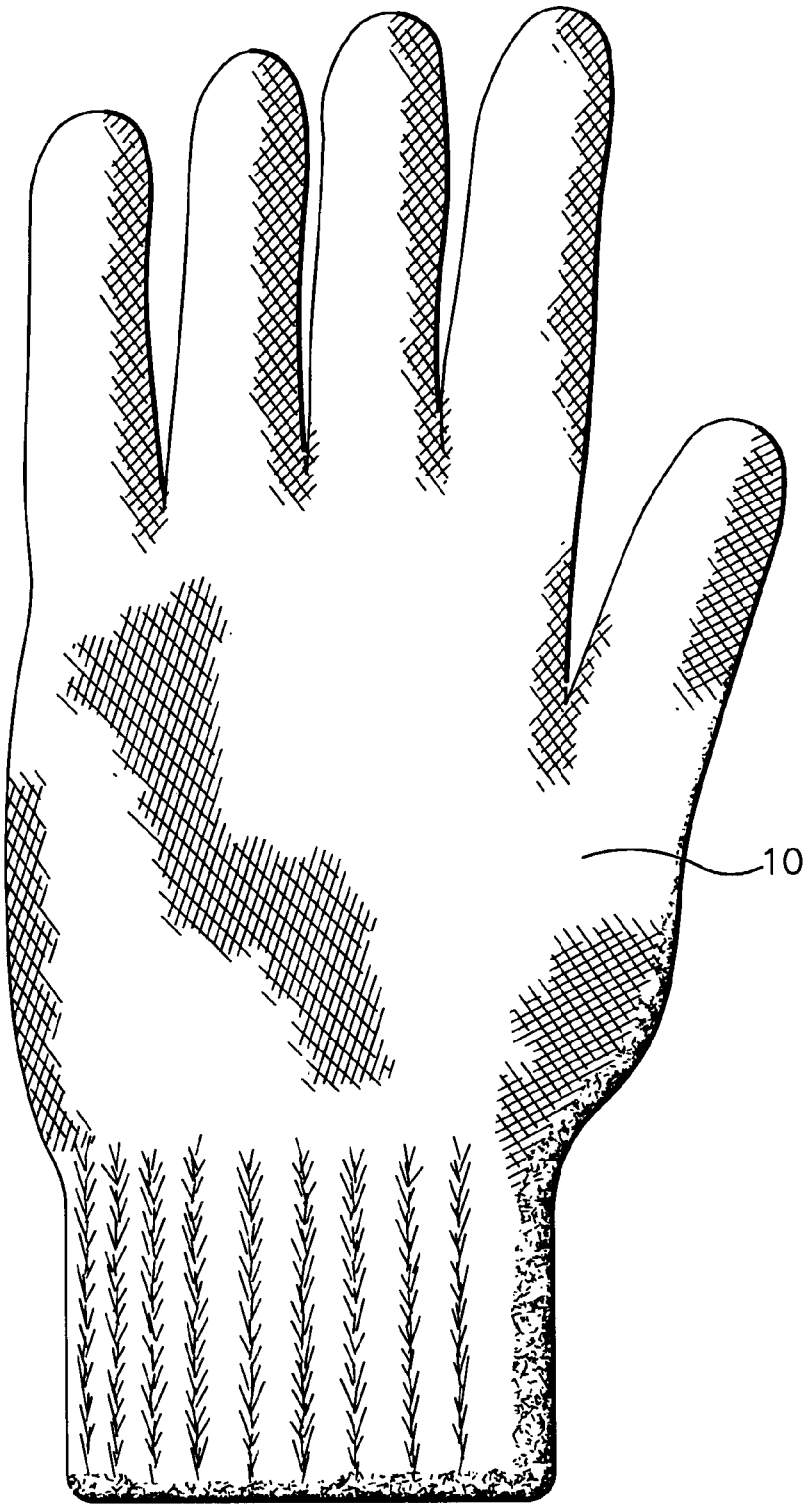
FIG. 1 is a perspective view of a glove with a yarn according to the present invention.

Referring now to the drawings, FIG. 1 illustrates a glove 10 which is made from the yarn of the present invention and which provides an example of a protective apparel item according to the present invention. The glove is particularly suited for use by an individual handling and processing food, although the glove could be utilized for many other known purposes. In addition, other protective apparel items, such as mittens, aprons, and sleeves, which would typically be worn by an individual handling and processing food could be made from the yarn of the present invention.

The glove 10 is cut-resistant so that it is long lasting and to a certain degree can prevent injuries. In addition, the glove 10 is provided with an antimicrobial substance embedded in the yarn from which the glove is made in order to enhance the sanitary condition of the workplace. For example, as will be discussed in detail, the yarn may include strands of a fiber sold under the trademark MICROSAFE® which is manufactured by Celenese. The MICROSAFE® fiber is an acetate fiber with an antimicrobial substantially permanently embedded therein. Thus, the antimicrobial embedded in the yarn of the glove 10 limits growth of germs on the glove 10 and the transfer of germs from the glove 10 to the food contacting the glove 10.

One advantage of the glove 10 is that it can be subjected to numerous washings without the antimicrobial being washed from the glove. Thus, the cut-resistant glove is washable and reusable The yarn of the present invention is described below in the following three examples of a bacteria fighting lightweight, medium weight and heavy weight yarn. In each example, the yarn 12 consists of a core 14 including a first and second fiber, 16 and 18, respectively. See FIGS. 2 and 3. In addition, the yarn 12 has a pair of counter opposing fiber helixes, 20 and 22, overwrapped on the core 14. Preferably, the core 14 and the helix 20 provide cut-resistant properties to the yarn 12, while the helix 22 provides the antimicrobial property.

EXAMPLE 1

Lightweight

Figure 2:
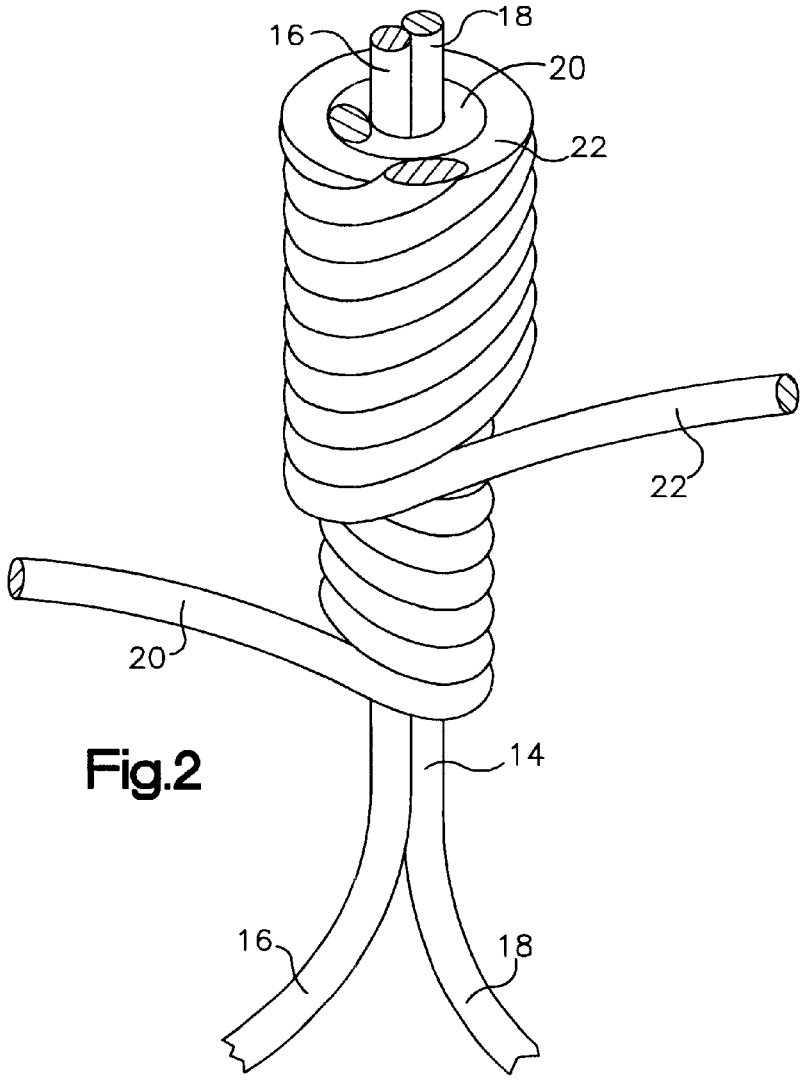
FIG. 2 is a perspective view of a yarn structure according to the present invention.
Figure 3:
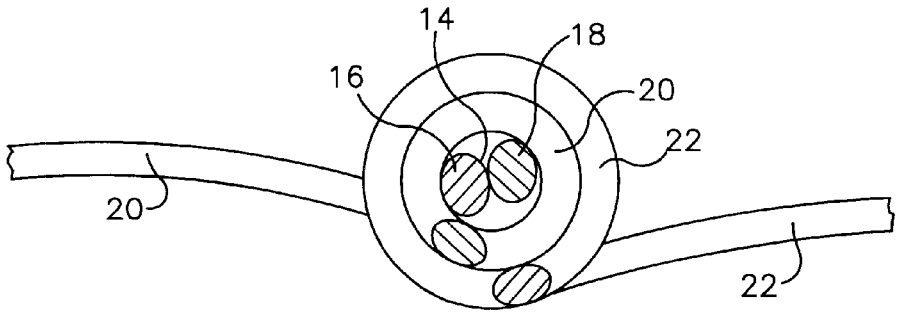
FIG. 3 is a transverse cross sectional view of the yarn structure illustrated in FIG. 2.

The lightweight yarn has a double core 12 as illustrated in FIGS. 2 and 3. The core 12 consists of a first and second fiber, 14 and 16, respectively. The first fiber 14 is fiberglass, preferably E-225 fiberglass, and the second fiber 16 is a polyester fiber, preferably of 140 denier. The "E" designates that it is an electrical type of fiberglass and the "225" designates the size of the fiberglass, the higher the number the finer the size. Denier is the measurement of the size or fineness of the fiber.

The first wrap 20 on the core 12 is preferably 375 denier SPECTRA® fiber which is a high density polyethylene fiber manufactured by Allied Signal. The second wrap 22 is preferably a 150/2 denier MICROSAFE® acetate fiber which is manufactured by Celenese and has an embedded antimicrobial.

This lightweight yarn is knitted one end in on a 13 gage Shima Seika Machine.

EXAMPLE 2

Medium Weight

The medium weight yarn also has a double core 14 as illustrated in FIGS. 2 and 3. The core 14 consists of a first and second fiber, 16 and 18, respectively. The first fiber 16 is fiberglass, preferably E-150 fiberglass, and the second fiber 18 is a polyester fiber, preferrably of 440 denier.

The first wrap 20 on the core 12 is preferably 375 denier SPECTRA® fiber which is a high density polyethylene fiber. The second wrap 22 is preferably a 150/2 denier MICROSAFE® acetate fiber which has an embedded antimicrobial.

This medium weight yarn is knitted two ends in on a 7 gage Shima Seika Machine.

EXAMPLE 3

Heavy Weight

The heavy weight yarn has a double core 12 as illustrated in FIGS. 2 and 3. The core 14 consists of a first and second fiber, 16 and 18, respectively. The first fiber 16 is fiberglass, preferrably E fiberglass, and the second fiber 18 is a 650 denier SPECTRA®, which is a high density polyethylene fiber.

The first wrap 20 on the core 12 is preferably 650 denier SPECTRA® fiber which is a high density polyethylene fiber. The second wrap 22 is preferably a 150/2 denier MICROSAFE® acetate fiber which has an embedded antimicrobial.

This heavy weight yarn is knitted one end in with the previously discussed medium weight yarn on a 7 gage Shima Seika Machine.

All three of the above described yarns are capable of being knitted into various washable and reuseable protective apparel, such as described heretofore, but in particular the glove 10. The glove 10 is worn by itself on the hand of an individual, or is utilized with other gloves located under the glove 10, over the glove 10, or both. The glove 10 affords the required degree of dexterity while providing resistance to cuts and to the collection and transmittal of bacteria Thus, the gloves are especially useful during the handling and processing of food.

Various modifications to the yarns are contemplated. Different fibers carrying an antimicrobial could be utilized in place of the MICROSAFE® fiber. The core could consist of more, or less, fibers and of different cut-resistant fibers. In addition, more, or less overwrapping fibers could be utilized, and different sized fibers could be utilized.

While preferred embodiments of a cut-resistant and antimicrobial yarn have been described, various modifications, alterations, and changes may be made without departing from the spirit and scope of the present invention as defined in the appended claims.

What is claimed is:

1. A cut-resistant yarn for fabricating into washable and reusable protective apparel, comprising a cut-resistant core fiber overwrapped with an outermost helically wound fiber having an antimicrobial embedded therein.

2. A cut resistant yarn according to claim 1, wherein said helix having an antimicrobial material embedded therein is an acetate fiber.

3. A cut-resistant yarn according to claim 2, wherein said core fiber includes a strand of fiberglass.

4. A cut-resistant yarn according to claim 3, further comprising a second helical wrap on said core fiber of a strand of high density polyethylene fiber.

5. A cut-resistant yarn according to claim 4, wherein said core includes a strand of polyester fiber.

6. A cut resistant yarn according to claim 4, wherein said core includes a strand of high density polyethylene fiber.

7. A cut-resistant yarn for fabricating into protective apparel particularly useful in food processing and handling, comprising:

a core having at least one strand of fiberglass;

a first helical wrap on said core; and an outermost helical wrap on said core, counter-opposed to said first helical wrap, of only one strand of a fiber having an embedded antimicrobial material.

8. A cut-resistant yarn according to claim 7, wherein said second helical wrap having embedded antimicrobial material is an acetate fiber.

9. A cut-resistant yarn according to claim 8, wherein said first helical wrap is high density polyethylene.

10. A cut-resistant yarn according to claim 9, wherein said core includes at least one strand of polyester fiber.

11. A cut resistant yarn according to claim 9, wherein said core includes at least one strand of high density polyethylene.

12. A cut-resistant yarn for fabricating into washable and removable protective apparel particularly useful in food processing and handling, consisting essentially of:

a core including fiberglass and one other material;

a first helical wrap on said core; and an outermost helical wrap on said core, counter-opposed to said first helical wrap, of a fiber having an embedded antimicrobial material.

13. A cut-resistant yarn according to claim 12, wherein said second helical wrap having embedded antimicrobial material is an acetate fiber.

14. A cut-resistant yarn according to claim 13, wherein said first helical wrap is high density polyethylene.

15. A cut-resistant yarn according to claim 14, wherein said other core material is polyester fiber.

16. A cut-resistant yarn according to claim 14, wherein said other core material is high density polyethylene.

17. A glove knitted from the cut-resistant, antimicrobial yarn according to claim 1.

18. A glove knitted from the cut-resistant, antimicrobial yarn according to claim 7.

19. A glove knitted from the cut-resistant, antimicrobial yarn according to claim 12.

20. A cut-resistant yarn for fabricating into washable and removable protective apparel particularly useful in food processing and handling, comprising:

a) a core including a fiberglass fiber and a high density polyethylene fiber;

b) a high density polyethylene fiber helical wrap on said core; and c) an outermost acetate fiber helical wrap having an embedded antimicrobial, counter opposed to said high density polyethylene fiber helical wrap.

* * * * *